United States Patent [19]

Hacias

[11] Patent Number: 4,539,051

[45] Date of Patent: Sep. 3, 1985

[54] PROCESS FOR PRODUCING PHOSPHATE COATINGS

[75] Inventor: Kenneth J. Hacias, Sterling Heights, Mich.

[73] Assignee: Parker Chemical Company, Madison Heights, Mich.

[21] Appl. No.: 690,431

[22] Filed: Jan. 10, 1985

Related U.S. Application Data

[63] Continuation-in-part of Ser. No. 469,621, Mar. 2, 1983, abandoned.

[51] Int. Cl.[3] ..... C23C 1/10; C25D 13/00

[52] U.S. Cl. ..... 148/6.15 Z; 148/6.15 R; 204/181.3; 427/419.5; 427/419.7

[58] Field of Search ..... 148/6.15 Z, 6.15 R; 204/181 R, 181 C, 469, 621; 427/409, 419.5, 419.7

[56] References Cited

U.S. PATENT DOCUMENTS

| | | | |
|---|---|---|---|
| 2,310,239 | 2/1943 | Jernstedt | 148/6 |
| 2,874,081 | 2/1959 | Cavanagh et al. | 148/6.15 |
| 3,222,226 | 12/1965 | Maurer et al. | 148/6.16 |
| 3,279,958 | 10/1966 | Maurer et al. | 148/6.16 |
| 3,664,887 | 5/1972 | Atkiss | 148/6.16 |
| 4,110,129 | 8/1978 | Matsushima et al. | 148/6.15 R |
| 4,152,170 | 5/1979 | Guhde | 148/6.15 R |
| 4,165,242 | 8/1979 | Kelly et al. | 148/6.15 Z |
| 4,497,666 | 2/1985 | Schapira et al. | 148/6.15 R |

*Primary Examiner*—Thurman K. Page

*Attorney, Agent, or Firm*—Arthur E. Kluegel

[57] ABSTRACT

An improved process for activating metal surfaces prior to a phosphating treatment whereby relatively thin, dense, fine-sized and uniform crystalline adherent phosphate coatings are produced providing superior corrosion protection and paint adherence when coated substrates are subjected to cyclical temperature and ambient environments typifying normal service conditions. To prepare the aqueous activating solution, a dry activating composition is prepared which is adapted to be dispersed in water at a controlled concentration and which comprises a mixture of about 60 to about 90% by weight of a particulated dried reaction product of a titanium-containing compound and sodium phosphate compound containing at least about 0.005% by weight titanium with the balance comprising tetrasodium pyrophosphate. The dry activating composition is dispersed in the aqueous solution to provide a total concentration of from about 0.1 to about 10 g/l. In accordance with the process aspects of the present invention, the aqueous dispersion containing the activating composition is applied to cleaned metal surfaces such as steel, zinc and aluminum before the following zinc phosphating step whereby improved phosphating coatings are produced.

27 Claims, No Drawings

PROCESS FOR PRODUCING PHOSPHATE COATINGS

REFERENCE TO RELATED APPLICATIONS

This application is a continuation-in-part of prior copending U.S. patent application Ser. No. 469,621 filed Mar. 2, 1983 now abandoned.

BACKGROUND OF THE INVENTION

A variety of compositions and processes have heretofore been used or proposed for use for effecting the formation of an adherent, uniform phosphate coating on metal surfaces to enhance the adhesion of subsequently applied siccative coatings and to provide for substantially improved corrosion resistance of the coated substrate. Phosphate coating processes of the various types well known and practiced in the art conventionally comprise aqueous acidic solutions which are applied to a cleaned metal surface such as by spraying, immersion, flooding or the like for a period of time sufficient to form a crystalline phosphate coating thereon. Numerous improvements in such phosphate coating processes and compositions have been made since their early introduction including the development of an activating pretreatment to accelerate the formation of a phosphate coating on a metal surface and to increase the uniformity of the coating produced. One such activating treatment is taught in U.S. Pat. No. 2,310,239 to Jernstedt in which the cleaned metal surface is first contacted with an aqueous dispersion of a dried disodium phosphate-titanium compound reaction product containing from about 0.005 to about 20 percent by weight titanium prior to contact with the subsequent phosphating solution. An improved method for producing the phosphate-titanium reaction product is taught in U.S. Pat. No. 2,874,081 to Cavanagh and Maurer the teachings of which are incorporated herein by reference.

The continuing demand for still further improvements in the corrosion resistance of metal substrates, particularly ferrous-base, zinc-base and aluminum-base substrates as employed in automotive applications has provided impetus in the development of still further improvements to substantially enhance corrosion protection and adherence of various siccative organic finishes including electrophoretic coatings applied to automobile body and chassis components. The advent of more stringent corrosion test procedures adopted by automobile manufacturers including a so-called cycle test as an indication of the projected service life of a treated automotive component has rendered many of the prior art phosphating processes and compositions deficient in passing such rigorous test conditions.

The present invention provides for an improved activation composition and process for activating metal surfaces prior to a phosphating treatment employing comparatively low concentrations of the activating constituents thereby achieving substantial economy in the treatment of metal surfaces while at the same time producing comparatively thin, dense, fine-size crystalline adherent phosphate coatings providing superior corrosion protection in comparison to prior art compositions and processes heretofore known.

SUMMARY OF THE INVENTION

The benefits and advantages of the present invention are achieved by providing a dry activating composition adapted for dispersion in water in a controlled concentration for activating metal surfaces for subsequent reaction with a high-zinc phosphate coating solution to achieve a dense, relatively thin adherent phosphate coating of relatively fine-sized crystals generally of a size of about 5 to about 10 microns. The dry activating composition comprises a particulated mixture containing from about 60% to about 90% by weight of a dried reaction product of a titanium-containing compound and sodium phosphate compound containing at least about 0.005% by weight titanium up to about 5% by weight titanium in combination with tetrasodium pyrophosphate. The dry activating composition may optionally, but preferably, further contain up to about 5% by weight of monosodium phosphate based on the total weight of the mixture.

An aqueous bath suitable for activating metal surfaces prior to zinc phosphating is comprised by dispersing the dry activating composition in water to provide a concentration of the activating composition within a range of about 0.1 up to about 10 grams (g/l) with concentrations of from about 0.75 to about 3 g/l being preferred. The specific concentration of the activating composition will depend to some extent on the concentration of titanium present in the reaction product of the activating mixture and is usually controlled within the foregoing ranges to provide a concentration of titanium in the activating solution within a range of about 0.001 to about 0.01 g/l.

In accordance with the process aspects of the present invention, a cleaned, metal substrate is contacted with the aqueous activating solution at a temperature of from about 75° F. up to about 130° F. for a period of from about 15 seconds up to about 5 minutes whereafter the activated metal surface is contacted with a high-zinc phosphate solution of any of the types wellknown in the art for forming an adherent extremely fine crystalline size dense phosphate coating thereover. Conventionally, the phosphated substrate is usually water rinsed followed by a sealing or post treatment rinse which may contain hexavalent and/or trivalent chromium ions or may comprise a chromium-free rinse solution to enhance the corrosion resistance of the phosphated surface. The post treatment rinsed surface is usually subjected to a further water rinse and may be subjected to a drying step before one or a plurality of organic siccative coating are applied thereover. In those instances in which water base coatings are to be employed such as cathodically applied electrophoretic coatings, the drying step can be omitted.

Additional benefits and advantages of the present invention will become apparent upon a reading of the Description of the Preferred Embodiments taken in conjunction with the specific examples provided.

DESCRIPTION OF THE PREFERRED EMBODIMENTS

The dry activating composition of the present invention adapted for dispersion in water for contacting metal surfaces to effect an activation thereof for subsequent reaction with zinc phosphate coating solutions comprises a controlled mixture of a particulated dry reaction product of a titanium-containing compound and sodium phosphate compound which contains about 0.005% up to about 5% titanium in combination with particulated tetrasodium pyrophosphate. It will be understood that the term "reaction product" as herein disclosed and as set forth in the subjoined claims encompasses a reaction product produced by forming an aqueous alkaline dispersion and/or solution of a sodium phosphate compound and a titanium compound sufficient to provide titanium ions which are reacted for a period of time whereafter the aqueous reaction medium is evaporated to dryness and the dry reaction product is advantageously comminuted to break up any agglomerates formed. One method of preparing such a reaction product is described in U.S. Pat. No. 2,310,239 to Jernstedt in which an aqueous solution containing ortho-disodium phosphate is prepared to which a titanium compound is added in the presence of agitation and the subsequent solution is evaporated to dryness at temperatures preferably above about 60° C. According to the aforementioned patent, soluble titanium compounds are preferably employed such as titanium tetra-chloride, titanium trichloride, titanium hydroxide, titanium nitride and titanium potassium oxalate although less soluble titanium compounds such as titanium carbide, titanium dioxide and titanium potassium fluoride have also produced satisfactory compounds. The reaction product upon evaporation to dryness contains from about 0.005 up to about 20% by weight of the titanium constituent.

A preferred method for preparing the reaction product is disclosed in U.S. Pat. No. 2,874,081 to Cavanagh and Maurer the teachings of which are incorporated herein by reference. Briefly stated, the method disclosed in the last mentioned patent comprises the formation of an aqueous solution containing a titanium compound, preferably titanyl sulphate although other titanium containing compounds which provide the titanium ion can also be satisfactorily employed, and adding to the resultant solution a phosphate compound in the presence of agitation to form a slurry. The slurry is intimately mixed for at least about 10 minutes at low temperatures and the pH of the slurry is adjusted between about 5.7 and 7.8 such as by the adition of sulfuric acid or sodium hydroxide. This initial mixing or conditioning stage is preferably conducted at a maximum temperature of about 75° F.

At the completion of the preconditioning stage which may range from about 10 minutes to as long as about 1 hour, the slurry is then heated to an elevated temperature usually ranging from about 160° to about 190° F. for a further aging treatment usually for a period of about 30 minutes or longer whereafter the slurry is dried to form a powdered reaction product comprising the activating composition.

In preparing the aqueous reaction slurry, phosphate of sodium compounds can be employed including disodium ortho-phosphate, sodium tripolyphosphate and tetrasodium pyrophosphate as well as mixtures thereof in which the latter two are employed in a concentration equivalent to that produced when employing disodium phosphate to achieve the same $P_2O_5$ concentration. The titanium compound and sodium phosphate compounds are employed in amounts such that the dried reaction product contains at least about 0.005% up to about 5% by weight titanium.

The resultant dried reaction product is preferably comminuted and the resultant particulated reaction product is admixed with a particulated tetrasodium pyrophosphate in an amount to provide a concentration of the reaction product of from about 60% up to about 90% by weight based on the total dry mixture. This can conveniently be achieved employing a suitable blending apparatus such as a ribbon blender for forming a substantially uniform mixture of these constituents. It is further contemplated that monosodium phosphate in a particulated form can be incorporated in the mixture in an amount up to about 5% by weight of the total mixture.

In the preparation of an aqueous solution for activating metal surfaces for subsequent treatment in a zinc phosphate coating process, the dried mixture is dispersed in water to produce an aqueous pretreatment solution having a concentration of titanium ions ranging from about 0.0002% up to about 0.05% by weight which generally corresponds to a concentration of the dry activating mixture of from about 0.1 to about 10 g/l. The pH of the pretreatment or activating solution can range from about 7 up to about 10 with a pH of about 8 to about 9.5 being preferred. The activating solution can be applied to the metal substrate being treated by spray, immersion or flooding of which spray application is preferred. The period of treatment during which the activating solution is in contact with the metal surface can usually range from as low as about 15 seconds up to about 5 minutes or even longer without any adverse effects.

In accordance with a preferred embodiment in the practice of the process of the present invention, the dried mixture is dispersed in the form of a concentrated aqueous pretreatment solution in the presence of agitation and is injected under pressure in the header to which the spray nozzles are connected for admixture with the balance of the recirculated pretreatment solution forming an activating solution containing the specified concentration of activating ingredients as hereinabove set forth. In accordance with a typical commercial installation, the activating solution spray applied to the clean metal surfaces is recovered and returned to a storage tank from which it is again pumped under pressure to the spray header. The activating composition is introduced into a smaller so-called "day tank" equipped with agitation to provide a concentrated solution typically in an amount of about 10 to 15 g/l (about 1 pound of the dry material per 10 gallons solution) which is pumped and injected under pressure into the spray header for admixture with the recirculated activating solution from the storage tank to attain a composite activating solution of the desired activating concentration. The use of such a concentrate for admixture and dilution with the recirculated activating solution provides for improved uniformity and better control of the composition of the activating solution at the point of spray application to the metal surfaces.

Following the activating treatment, the activated metal substrate with or without an intervening water rinse is subjected to a so-called high-zinc phosphating treatment employing compositions and conditions of any of the types known in the art and particularly such as described in U.S. Pat. No. 2,835,617 to Maurer, the teachings of which are incorporated herein by reference. For the purposes of the present invention as herein described and as set forth in the subjoined claims, high-zinc phosphate solutions are intended to encompass aqueous acidic solutions as described in the aforementioned patent containing about 0.5 to about 2.5 percent by weight phosphate ions, zinc ions in an amount sufficient to form dihydrogen phosphate ions and preferably less than about 0.5 percent zinc ions to provide a phosphate to zinc ion ratio of less than 5:1, oxidizing ions such as nitrate and/or nitrite with nitrate ions being present from about 0.2 to about 1 percent, preferably about 0.3 to about 0.5 percent, and nitrite ions about 0.0002 to about 0.008 percent, preferably less than about 0.005 percent; nickel ions from about 0.01 to about 0.4 percent, preferably less than about 0.3 percent; optionally, copper ions from about 0.0003 to about 0.005 percent, and preferably, about 0.0003 to about 0.001 percent, soluble silicon such as introduced by sodium silicofluoride present in an amount 0.03 percent up to saturation and preferably from about 0.03 to about 0.1 percent, fluoride ions present in an amount sufficient to stabilize the bath, and a total acidity as measured in accordance with the definition provided in the accompanying example of less than about 40 points. The aqueous zinc phosphating solution is applied to the substrate at a temperature of about 130° to about 180° F., preferably from about 130° to about 160° F.

Following the phosphating treatment, the phosphated substrate is usually water rinsed and is thereafter subjected to a final post rinse treatment which may comprise solutions employing hexavalent and/or trivalent chromium ions in an aqueous solution of a general composition such as described in U.S. Pat. Nos. 3,222,226 and 3,279,958 the substance of which is incorporated herein by reference.

Alternative satisfactory chromium-free post treating compositions that can be employed include aqueous and/or solvent solutions of a water soluble, or water dispersible or water emulsifiable derivatives of polyalkenylphenol polymers such as isopropenylphenol, isobutenylphenol, dimethylvinylphenol or the like as more fully disclosed in pending U.S. patent application Ser. No. 490,579, filed May 9, 1983, entitled "Treatment of Metal With Derivative of Poly-Alkenylphenol" the teachings of which are incorporated herein by reference. As more fully described in the aforementioned pending application, the poly-alkenylphenol derivative compounds can range in molecular weight from the dimer, more usually low molecular weight oligomers of molecular weights of about 360 to high molecular weight polymers of 30,000 or greater. The upper limit of molecular weight is functionally limited to that at which the derivative remains soluble or dispersible. The compound is employed in the operating post-treatment solution within a range of about 0.01 up to about 5 percent by weight with concentrations of about 0.025 to about 1 percent by weight being preferred. The solution has a pH of about 0.5 to about 12, preferably about 2 to about 8 and is applied by spray, immersion, flooding or the like at temperatures of about 70° to about 160° F. for contact times of as little as 2 to 5 seconds or even longer.

The chromium-free post treatment solution may optionally contain 0.001 to about 1 percent by weight of metal ions such as titanium, zirconium, hafnium and mixtures and salts thereof to further increase the effectiveness of the post treatment. Optionally and additionally, the solution can contain organic additive agents in combination with or in the absence of the aforementioned metal ions such as about 0.01 to about 4 percent of thiourea, alkyl or aryl thiourea compounds, tannic acid, vegetable tannins or gall tannins as well as mixtures thereof.

In addition to the foregoing post-treating composition, alternative satisfactory chromium-free post-treating solutions include those as described in U.S. Pat. Nos. 3,975,214; 4,039,353 and 4,376,000 which through mesne Assignments are assigned to the assignee of the present invention and the teachings of which are incorporated herein by reference. The chromium-free post-treating composition as described in U.S. Pat. No. 3,975,214 comprises a dilute aqueous solution containing about 0.1 to about 10 g/l of a vegetable tannin which is applied at a temperature ranging from about ambient up to about 200° F. at a ph less than about 6, and preferably from about 3 to about 6. The chromium-free post-treating composition as described in U.S. Pat. No. 4,039,353 comprises an aqueous solution containing a melamine-formaldehyde resin preferably in further combination with a vegetable tannin in which the resin concentration can range as low about 0.01 g/l to concentrations up to about 100 g/l. The operating post-treating solution is adjusted to a pH of from about 2 up to about 10 and is contacted with the zinc phosphated surface at temperatures generally ranging from about ambient up to about 100° F. The chromium-free post-treating solution as described in U.S. Pat. No. 4,376,000 comprises a dilute aqueous solution containing the reaction product of poly-4-vinylphenol and formaldehyde as well as derivatives and salts thereof in which the concentration of the active ingredient can generally range from about 0.01 percent up to about 5 percent by weight. The post-treating solution is applied at temperatures preferably ranging from about 70° F. up to about 160° F.

Following the post treatment with the foregoing chromium-free treating solutions, the phosphate treated surfaces are generally preferably water rinsed prior to the electrophoretic coating step.

The post treatment rinsed phosphated substrate is usually again water rinsed, preferably employing deionized water and is thereafter dried prior to the application of one or a plurality of organic siccative coatings thereover. In those instances in which an aqueous coating system is to be employed, a drying of the substrate may not be required and is unnecessary in the case where the phosphated substrate is to be immersed in a cathodic electrophoretic coating system which is now extensively employed in coating automobile body and chassis components to enhance corrosion resistance thereof.

In order to further illustrate the benefits and advantages of the present invention, the following specific examples are provided. It will be understood that the examples are provided for illustrative purposes and are not intended to be limiting of the scope of the invention as herein disclosed and as set forth in the subjoined claims.

EXAMPLE 1

A series of 4 inch by 12 inch test panels comprising a cold rolled type 1010 steel panel, a hot dip galvanized panel and an aluminum panel was subjected to a typical process for applying a phosphate coating on the surfaces thereof in accordance with the preferred practice of the present invention whereafter the panels were painted and subject to a cycle test to predict the long term durability and corrosion resistance of the treated panels.

The phosphating process included a preliminary cleaning of the surfaces of the panel employing a mild alkaline silicated aqueous cleaning solution at a temperature of about 140° F. which was spray applied for a period of 60 seconds. Following the cleaning step, the panels were contacted with a spray of an aqueous rinse solution containing the activating composition of the present invention for a period of 30 seconds at room temperature (75° F.) and at a pH of about 8.5. The activating solution contained 0.8 g/l of the titanium-phosphate reaction product and 0.2 g/l of tetrasodium pyrophosphate providing a total titanium concentration of about 0.008 g/l.

Following the activation rinse treatment, the panels were contacted with a spray applied high-zinc phosphating solution for a period of 60 seconds containing about 1.6 g/l zinc ions, about 4.6 g/l phosphate ions, about 1.8 g/l nitrate ions, about 0.9 g/l fluoride ions, about 0.9 g/l nickel ions, about 0.04 to about 0.6 g/l nitrite ions and the balance water. The zinc phosphating solution was applied at a temperature of about 140° F. at a total acidity of about 13 points and a free acidity of about 0.8. The points of total acidity is established by the milliliters of 0.1N sodium hydroxide solution required to neutralize a 10 milliliter sample of the solution to a pH of 8.2 while the points of free acid is established by the number of milliliters of the same caustic solution required to neutralize 10 milliliters of the solution to a pH of 3.8.

The phosphated test panels are thereafter water rinsed employing cold water which is spray applied for a period of 30 seconds followed by a final chromium rinse sealing treatment spray applied for a period of 15 seconds. The chromium rinse solution is at a pH of about 4.4 containing a total concentration of chromium ions of from about 200 to about 1,000 ppm and having a weight ratio of hexavalent chromium to trivalent chromium of about 2:1.

Following the chromium rinse treatment, the test panels were sprayed for a period of 15 seconds with a deionized water rinse at room temperature whereafter the panels were immersed in an aqueous bath at a temperature of 80° F. containing a cathodic black electropaint designated as PPG 3002 and were cathodically electrified to deposit a paint film thickness of about 0.65 to about 0.75 mils. The panels were removed and thereafter baked at about 360° F. for about 20 minutes to cure the black electropaint primer. The preliminary coated panels were thereafter coated by spray application with a thermosetting, high-solids solvent thinned primer-sealer organic coating available under the designation PPG 80-703 to provide a paint film thickness of about 0.8 to about 1.0 mils. The panels were thereafter baked for a period of 30 minutes at 350° F. to effect a curing of the primer-sealer coating.

Finally, an acrylic lacquer top coat designated as DuPont 396-Y-99612 comprising a white, 27% Lucite dispersion lacquer was spray applied to a film thickness of about 2 to about 2.5 mils whereafter the panels were subjected to a final bake at 325° F. for 30 minutes. The painted test panels were thereafter aged for a period of 3 days and were thereafter scribed on one face thereof with a vertical scribe line passing through the organic coatings and phosphate coatings to the base metal.

The scribed panels were thereafter subjected to a cyclical corrosion test for a period of 4 weeks employing a weekly cycle as follows: On the first day, the panels were heated in dry heat to a temperature of about 140° F. for a period of 1 hour and thereafter chilled to a temperature of −10° F. for a period of 30 minutes followed by a 15 minute immersion in a 5% solution of sodium chloride at room temperature. The panels were then retained for a period of 90 minutes at ambient temperature and thereafter replaced in a humidity chamber at 140° F. at 85% humidity for the balance of the 24 hour period. During each of the next 4 days, the panels were removed from the humidity chamber and immersed in a 5% sodium chloride solution at room temperature for 15 minutes followed by a 90 minute dwell period at ambient temperature and returned for the balance of the 24 hour period in the humidity chamber at 140° F. and 85% humidity. During the sixth and seventh days, the panels remained in the humidity chamber at 140° F. and 85% humidity.

At the conclusion of the 4 week cyclical test period, each of the steel, galvanized and aluminum test panels were inspected and were rated with respect to the condition of creepage of corrosion laterally from the scribe line. Under the rating system, a rating of 10 is excellent indicating no lateral creepage of corrosion whereas a rating of 0 indicates complete failure. The steel and galvanized test panels were rated at 9–10 while the aluminum test panels had a rating of 10. The excellent cycle test performance achieved by the coated test panels treated in accordance with the activating agent of the present invention is believed due to the uniform dense crystalline structure of the phosphate coating produced and the relatively small size and uniformity of the crystalline structure thereof.

Separate analyses of the phosphate coatings produced on the test panels prior to chromium rinsing and painting revealed that the coating weight on the steel test panels ranged from about 150 to about 200 milligrams per square foot (mg/sq.ft.) at a crystal size of about 5 to 10 microns. For the galvanized steel panels, the coating weight ranged from about 175 to about 250 mg/sq.ft. while for the aluminum test panel the coating weight ranged from about 70 to about 120 mg/sq.ft. at the same average crystal size of about 5 to about 10 microns.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An improved process for phosphating metal surfaces which comprises the steps of providing an activating composition comprising a mixture of about 60% to about 90% by weight of a particulated dried reaction product of a titanium-containing compound and a sodium phosphate compound containing at least about 0.005% by weight titanium and the balance comprising tetrasodium pyrophosphate, dispersing said activating composition in water at a concentration of about 0.1 to about 10 g/l to provide an activating solution, contacting a clean metal surface with said activating solution at a pH of about 7 to about 10 for a period of time of at least about 15 seconds to provide an activated metal surface, contacting the activated metal surface with an aqueous high-zinc phosphating solution for a period of time to produce a desired thickness of a zinc phosphate coating thereon, rinsing the zinc phosphate coating with a dilute aqueous solution containing chromium ions, and thereafter applying an electrophoretic organic coating to the rinsed zinc phosphate coating.

2. The process as defined in claim 1 in which the step of dispersing said activating composition is performed to provide a concentration of about 0.75 to about 3 g/l of said activating composition in said activating solution.

3. The process as defined in claim 1 in which the step of dispersing said activating composition is performed to provide a concentration of titanium in said activating solution of about 0.001 to about 0.01 g/l.

4. The process as defined in claim 1 in which the step of dispersing said activating composition is performed to provide a concentration of titanium in said activating solution of about 0.0002 to about 0.05% by weight.

5. The process as defined in claim 1 including the further step of controlling the temperature of said activating solution within a range of about 75° to about 130° F. during the step of spray applying said activating solution to a metal surface.

6. The process as defined in claim 1 in which the pH of said activating solution is controlled within a range of about 8 to about 9.5.

7. The process as defined in claim 1 in which the step of spray applying said activating solution is performed for a period of time up to about 5 minutes.

8. The process as defined in claim 1 including the further step of water rinsing the activated metal surface prior to the step of contacting the activated metal surface with the aqueous high-zinc phosphating solution.

9. The process as defined in claim 1 including the further step of water rinsing the zinc phosphate coating prior to the step of rinsing the zinc phosphate coating with the dilute aqueous solution containing chromium ions.

10. The process as defined in claim 1 including the further step of water rinsing the zinc phosphate coating following the step of rinsing the zinc phosphate coating with a dilute aqueous solution containing chromium ions.

11. The process as defined in claim 1 including the further step of drying the zinc phosphate coating prior to the step of applying the organic coating.

12. The process as defined in claim 1 in which the step of applying the organic coating includes immersing the zinc phosphate coated metal surface in an aqueous bath containing an electropaint therein and cathodically electrifying the metal surface to deposit a desired thickness of electropaint coating thereon.

13. The process as defined in claim 12 including the further steps of drying and curing the electropaint coating and thereafter applying at least one additional organic coating on the electropaint coating.

14. An improved process for phosphating metal surfaces which comprises the steps of providing an activating composition comprising a mixture of about 60% to about 90% by weight of a particulated dried reaction product of a titanium-containing compound and a sodium phosphate compound containing at least about 0.005% by weight titanium and the balance comprising tetrasodium pyrophosphate, dispersing said activating composition in water at a concentration of about 0.1 to about 10 g/l to provide an activating solution, contacting a clean metal surface with said activating solution at a pH of about 7 to about 10 for a period of time of at least about 15 seconds to provide an activated metal surface, contacting the activated metal surface with an aqueous high-zinc phosphating solution for a period of time to produce a desired thickness of a zinc phosphate coating thereon, post-treatment rinsing the zinc phosphate coating with a dilute post-treating solution to enhance the corrosion resistance of the zinc-phosphated surface, and thereafter applying an electrophoretic organic coating to the rinsed zinc phosphate coating.

15. An improved process for phosphating metal surfaces which comprises the steps of providing an activating composition comprising a mixture of about 60% to about 90% by weight of a particulated dried reaction product of a titanium-containing compound and a sodium phosphate compound containing at least about 0.005% by weight titanium and the balance comprising tetrasodium pyrophosphate, dispersing said activating composition in water at a concentration of about 0.1 to about 10 g/l to provide an activating solution, contacting a clean metal surface with said activating solution at a pH of about 7 to about 10 for a period of time of at least about 15 seconds to provide an activated metal surface, contacting the activated metal surface with an aqueous high-zinc phosphating solution for a period of time to produce a desired thickness of a zinc phosphate coating thereon, post-treatment rinsing the zinc phosphate coating with a dilute substantially chromium-free post-treating solution to enhance the corrosion resistance of the zinc-phosphated surface, and thereafter applying an electrophoretic organic coating to the rinsed zinc phosphate coating.

16. The process as defined in claim 15 in which the step of dispersing said activating composition is performed to provide a concentration of about 0.75 to about 3 g/l of said activating composition in said activating solution.

17. The process as defined in claim 15 in which the step of dispersing said activating composition is performed to provide a concentration of titanium in said activating solution of about 0.001 to about 0.01 g/l.

18. The process as defined in claim 15 in which the step of dispersing said activating composition is performed to provide a concentration of titanium in said activating solution of about 0.0002 to about 0.05% by weight.

19. The process as defined in claim 15 including the further step of controlling the temperature of said activating solution within a range of about 75° to about 130° F. during the step of spray applying said activating solution to a metal surface.

20. The process as defined in claim 15 in which the pH of said activating solution is controlled within a range of about 8 to about 9.5.

21. The process as defined in claim 15 in which the step of spray applying said activating solution is performed for a period of time up to about 5 minutes.

22. The process as defined in claim 15 including the further step of water rinsing the activated metal surface prior to the step of contacting the activated metal surface with the aqueous high-zinc phosphating solution.

23. The process as defined in claim 15 including the further step of water rinsing the zinc phosphate coating prior to the step of rinsing the zinc phosphate coating with the dilute substantially chromium-free post-treating solution.

24. The process as defined in claim 15 including the further step of water rinsing the zinc phosphate coating following the step of rinsing the zinc phosphate coating with the dilute substantially chromium-free post-treating solution.

25. The process as defined in claim 15 including the further step of drying the zinc phosphate coating prior to the step of applying the organic coating.

26. The process as defined in claim 15 in which the step of applying the organic coating includes immersing the zinc phosphate coated metal surface in an aqueous bath containing an electropaint therein and cathodically electrifying the metal surface to deposit a desired thickness of electropaint coating thereon.

27. The process as defined in claim 26 including the further steps of drying and curing the electropaint coating and thereafter applying at least one additional organic coating on the electropaint coating.

* * * * *